US007149683B2

(12) United States Patent
Jelinek

(10) Patent No.: US 7,149,683 B2
(45) Date of Patent: Dec. 12, 2006

(54) METHOD AND DEVICE FOR ROBUST PREDICTIVE VECTOR QUANTIZATION OF LINEAR PREDICTION PARAMETERS IN VARIABLE BIT RATE SPEECH CODING

(75) Inventor: Milan Jelinek, Sherbrooke (CA)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 11/039,659

(22) Filed: Jan. 19, 2005

(65) Prior Publication Data

US 2005/0261897 A1 Nov. 24, 2005

Related U.S. Application Data

(63) Continuation of application No. PCT/CA2003/001985, filed on Dec. 18, 2003.

(51) Int. Cl.
*G10L 19/04* (2006.01)
*G10L 11/06* (2006.01)

(52) U.S. Cl. ..... 704/208; 704/219; 704/220; 704/230

(58) Field of Classification Search ..... 704/219, 704/220, 221, 222, 224, 225, 229, 230, 206, 704/208, 214
See application file for complete search history.

(56) References Cited

U.S. PATENT DOCUMENTS 5,774,839 A * 6/1998 Shlomot ..... 704/222
5,956,672 A * 9/1999 Serizawa ..... 704/219
6,064,954 A * 5/2000 Cohen et al. ..... 704/207
6,104,992 A * 8/2000 Gao et al. ..... 704/220
6,122,608 A * 9/2000 McCree ..... 704/219
6,260,010 B1 * 7/2001 Gao et al. ..... 704/230
6,415,254 B1 * 7/2002 Yasunaga et al. ..... 704/223
6,475,245 B1 * 11/2002 Gersho et al. ..... 704/208
6,604,070 B1 * 8/2003 Gao et al. ..... 704/222
6,691,092 B1 * 2/2004 Udaya Bhaskar et al. .. 704/265
6,795,805 B1 * 9/2004 Bessette et al. ..... 704/223
6,885,988 B1 * 4/2005 Chen ..... 704/228
6,988,067 B1 * 1/2006 Kim et al. ..... 704/222
7,010,482 B1 * 3/2006 Gottesman et al. ..... 704/222
2003/0012137 A1 1/2003 Abdelilah et al.

OTHER PUBLICATIONS

Tammi et al., "Signal Modification for Voiced Wideband Speech Coding and Its Application for IS-95 System," Speech Coding, 2002, IEEE Workshop Proceedings, Oct. 6-9, 2002, pp. 35 to 37.*

(Continued)

*Primary Examiner*—Martin Lerner
(74) *Attorney, Agent, or Firm*—Harrington & Smith, LLP

(57) ABSTRACT

The present invention relates to a method and device for quantizing linear prediction parameters in variable bit-rate sound signal coding, in which an input linear prediction parameter vector is received, a sound signal frame corresponding to the input linear prediction parameter vector is classified, a prediction vector is computed, the computed prediction vector is removed from the input linear prediction parameter vector to produce a prediction error vector, and the prediction error vector is quantized. Computation of the prediction vector comprises selecting one of a plurality of prediction schemes in relation to the classification of the sound signal frame, and processing the prediction error vector through the selected prediction scheme. The present invention further relates to a method and device for dequantizing linear prediction parameters in variable bit-rate sound signal decoding.

58 Claims, 8 Drawing Sheets

OTHER PUBLICATIONS

Ahmadi et al., "Wideband Speech Coding for CDMA2000 Systems," Conference Record of the Thirty-Seventh Asilomar Conference on Signals, Systems and Computers, 2003, Nov. 9-12, 2003, vol. 1, pp. 270 to 274.*

Salami et al., "The Adaptive Multi-Rate Wideband Codec: History and Performance," Speech Coding, 2002, IEEE Workshop Proceedings, Oct. 6-9, 2002, pp. 144 to 146.*

Bessette et al., "Efficient Methods for High Quality Low Bit Rate Wideband Speech Coding," Speech Coding, 2002, IEEE Workshop Proceedings, Oct. 6-9, 2002, pp. 114 to 116.*

Jelinek et al, "On the Architecture of the CDMA2000 Variable-Rate Multimode Wideband (VMR-WB) Speech Coding Standard," IEEE International Conference on Acoustics, Speech, and Signal Processing, 2004. Proceedings. May 17-21, 2004, vol. 1, pp. 281 to 284.*

"Wideband Coding of Speech at Around 16 kbits/s using Adaptive Multi-rate Wideband, AMR-WB", Oct. 25, 2002, International Telecommunication Union, ITU-T G.722.2, 20 pgs.

Paskoy, E., et al., "Variable Bit-Rate CELP Coding of Speech with Phonetic Classification", Sep.-Oct. 1994, pp. 57-67.

Foodeei, M., et al., "A Low Bit Rate Codec for AMR Standard", 1999, IEEE, pp. 123-125.

Skoglund, J., et al., "Predictive VQ for Noisy Channel Spectrum Coding: AR or MA?", 1997, IEEE, pp. 1351-1354.

"Adaptive Multi-Rate—Wideband (AMR-WB) Speech Codec", 3GPP TS 26.190. V6.1.1 (Jul. 2005), 53 pgs.

"Coding of Speech at 8kbit/s Using Conjugate-Structure Algebraic-Code-Excited Linear-Prediction (CS-ACELP)", Mar. 1996, International Telecommunication Union, 39 pgs.

* cited by examiner

Quantized vector is $\hat{x} = \hat{x}_1 + \hat{x}_2$

METHOD AND DEVICE FOR ROBUST PREDICTIVE VECTOR QUANTIZATION OF LINEAR PREDICTION PARAMETERS IN VARIABLE BIT RATE SPEECH CODING

CROSS REFERENCE TO RELATED APPLICATION

This application is a continuation of International Patent Application No. PCT/CA2003/001985 filed on Dec. 18, 2003.

BACKGROUND OF THE INVENTION

1. Field of the Invention

The present invention relates to an improved technique for digitally encoding a sound signal, in particular but not exclusively a speech signal, in view of transmitting and synthesizing this sound signal. More specifically, the present invention is concerned with a method and device for vector quantizing linear prediction parameters in variable bit rate linear prediction based coding.

2. Brief Description of the Prior Techniques 2.1 Speech Coding and Quantization of Linear Prediction (LP) Parameters:

Digital voice communication systems such as wireless systems use speech encoders to increase capacity while maintaining high voice quality. A speech encoder converts a speech signal into a digital bitstream which is transmitted over a communication channel or stored in a storage medium. The speech signal is digitized, that is, sampled and quantized with usually 16-bits per sample. The speech encoder has the role of representing these digital samples with a smaller number of bits while maintaining a good subjective speech quality. The speech decoder or synthesizer operates on the transmitted or stored bit stream and converts it back to a sound signal.

Digital speech coding methods based on linear prediction analysis have been very successful in low bit rate speech coding. In particular, code-excited linear prediction (CELP) coding is one of the best known techniques for achieving a good compromise between the subjective quality and bit rate. This coding technique is the basis of several speech coding standards both in wireless and wireline applications. In CELP coding, the sampled speech signal is processed in successive blocks of N samples usually called frames, where N is a predetermined number corresponding typically to 10–30 ms. A linear prediction (LP) filter A(z) is computed, encoded, and transmitted every frame. The computation of the LP filter A(z) typically needs a lookahead, which consists of a 5–15 ms speech segment from the subsequent frame. The N-sample frame is divided into smaller blocks called subframes. Usually the number of subframes is three or four resulting in 4–10 ms subframes. In each subframe, an excitation signal is usually obtained from two components, the past excitation and the innovative, fixed-codebook excitation. The component formed from the past excitation is often referred to as the adaptive codebook or pitch excitation. The parameters characterizing the excitation signal are coded and transmitted to the decoder, where the reconstructed excitation signal is used as the input of a LP synthesis filter.

The LP synthesis filter is given by $$H(z) = \frac{1}{A(z)} = \frac{1}{1 + \sum_{i=1}^{M} a_i z^{-i}}$$

where $\alpha_i$ are linear prediction coefficients and M is the order of the LP analysis. The LP synthesis filter models the spectral envelope of the speech signal. At the decoder, the speech signal is reconstructed by filtering the decoded excitation through the LP synthesis filter.

The set of linear prediction coefficients $\alpha_i$ are computed such that the prediction error $$e(n)=s(n)-\tilde{s}(n) \tag{1}$$

is minimized, where s(n) is the input signal at time n and $\tilde{s}(n)$ is the predicted signal based on the last M samples given by:

$$\tilde{s}(n) = -\sum_{i=1}^{M} a_i s(n-i)$$

Thus the prediction error is given by:

$$e(n) = s(n) + \sum_{i=1}^{M} a_i s(n-i)$$

This corresponds in the z-tranform domain to:

$$E(z)=S(z)A(z)$$

where A(z) is the LP filter of order M given by:

$$A(z) = 1 + \sum_{i=1}^{M} a_i z^{-i}$$

Typically, the linear prediction coefficients $\alpha_i$ are computed by minimizing the mean-squared prediction error over a block of L samples, L being an integer usually equal to or larger than N (L usually corresponds to 20–30 ms). The computation of linear prediction coefficients is otherwise well known to those of ordinary skill in the art. An example of such computation is given in [ITU-T Recommendation G.722.2 "Wideband coding of speech at around 16 kbit/s using adaptive multi-rate wideband (AMR-WB)", Geneva, 2002].

The linear prediction coefficients $\alpha_i$ cannot be directly quantized for transmission to the decoder. The reason is that small quantization errors on the linear prediction coefficients can produce large spectral errors in the transfer function of the LP filter, and can even cause filter instabilities. Hence, a transformation is applied to the linear prediction coefficients $\alpha_i$ prior to quantization. The transformation yields what is called a representation of the linear prediction coefficients $\alpha_i$. After receiving the quantized transformed linear prediction coefficients $\alpha_i$, the decoder can then apply the inverse transformation to obtain the quantized linear prediction coefficients. One widely used representation for the linear prediction coefficients $\alpha_i$ is the line spectral frequencies (LSF) also known as line spectral pairs (LSP). Details of the computation of the Line Spectral Frequencies can be found in [ITU-T Recommendation G.729 "Coding of speech at 8 kbit/s using conjugate-structure algebraic-code-excited linear prediction (CS-ACELP)," Geneva, March 1996].

A similar representation is the Immitance Spectral Frequencies (ISF), which has been used in the AMR-WB coding standard [ITU-T Recommendation G.722.2 "Wideband coding of speech at around 16 kbit/s using Adaptive Multi-Rate Wideband (AMR-WB)", Geneva, 2002]. Other representations are also possible and have been used. Without loss of generality, the particular case of ISF representation will be considered in the following description.

The so obtained LP parameters (LSFs, ISFs, etc.), are quantized either with scalar quantization (SQ) or vector quantization (VQ). In scalar quantization, the LP parameters are quantized individually and usually 3 or 4 bits per parameter are required. In vector quantization, the LP parameters are grouped in a vector and quantized as an entity. A codebook, or a table, containing the set of quantized vectors is stored. The quantizer searches the codebook for the codebook entry that is closest to the input vector according to a certain distance measure. The index of the selected quantized vector is transmitted to the decoder. Vector quantization gives better performance than scalar quantization but at the expense of increased complexity and memory requirements.

Structured vector quantization is usually used to reduce the complexity and storage requirements of VQ. In split-VQ, the LP parameter vector is split into at least two subvectors which are quantized individually. In multistage VQ the quantized vector is the addition of entries from several codebooks. Both split VQ and multistage VQ result in reduced memory and complexity while maintaining good quantization performance. Furthermore, an interesting approach is to combine multistage and split VQ to further reduce the complexity and memory requirement. In reference [ITU-T Recommendation G.729 "Coding of speech at 8 kbit/s using conjugate-structure algebraic-code-excited linear prediction (CS-ACELP)," Geneva, March 1996], the LP parameter vector is quantized in two stages where the second stage vector is split in two subvectors.

The LP parameters exhibit strong correlation between successive frames and this is usually exploited by the use of predictive quantization to improve the performance. In predictive vector quantization, a predicted LP parameter vector is computed based on information from past frames. Then the predicted vector is removed from the input vector and the prediction error is vector quantized. Two kinds of prediction are usually used: auto-regressive (AR) prediction and moving average (MA) prediction. In AR prediction the predicted vector is computed as a combination of quantized vectors from past frames. In MA prediction, the predicted vector is computed as a combination of the prediction error vectors from past frames. AR prediction yields better performance. However, AR prediction is not robust to frame loss conditions which are encountered in wireless and packet-based communication systems. In case of lost frames, the error propagates to consecutive frames since the prediction is based on previous corrupted frames.

2.2 Variable Bit-rate (VBR) Coding:

In several communications systems, for example wireless systems using code division multiple access (CDMA) technology, the use of source-controlled variable bit rate (VBR) speech coding significantly improves the capacity of the system. In source-controlled VBR coding, the encoder can operate at several bit rates, and a rate selection module is used to determine the bit rate used for coding each speech frame based on the nature of the speech frame, for example voiced, unvoiced, transient, background noise, etc. The goal is to attain the best speech quality at a given average bit rate, also referred to as average data rate (ADR). The encoder is also capable of operating in accordance with different modes of operation by tuning the rate selection module to attain different ADRs for the different modes, where the performance of the encoder improves with increasing ADR. This provides the encoder with a mechanism of trade-off between speech quality and system capacity. In CDMA systems, for example CDMA-one and CDMA2000, typically 4 bit rates are used and are referred to as full-rate (FR), half-rate (HR), quarter-rate (QR), and eighth-rate (ER). In this CDMA system, two sets of rates are supported and referred to as Rate Set I and Rate Set II. In Rate Set II, a variable-rate encoder with rate selection mechanism operates at source-coding bit rates of 13.3 (FR), 6.2 (HR), 2.7 (QR), and 1.0 (ER) kbit/s, corresponding to gross bit rates of 14.4, 7.2, 3.6, and 1.8 kbit/s (with some bits added for error detection).

A wideband codec known as adaptive multi-rate wideband (AMR-WB) speech codec was recently selected by the ITU-T (International Telecommunications Union—Telecommunication Standardization Sector) for several wideband speech telephony and services and by 3GPP (Third Generation Partnership Project) for GSM and W-CDMA (Wideband Code Division Multiple Access) third generation wireless systems. An AMR-WB codec consists of nine bit rates in the range from 6.6 to 23.85 kbit/s. Designing an AMR-WB-based source controlled VBR codec for CDMA2000 system has the advantage of enabling interoperation between CDMA2000 and other systems using an AMR-WB codec. The AMR-WB bit rate of 12.65 kbit/s is the closest rate that can fit in the 13.3 kbit/s full-rate of CDMA2000 Rate Set II. The rate of 12.65 kbit/s can be used as the common rate between a CDMA2000 wideband VBR codec and an AMR-WB codec to enable interoperability without transcoding, which degrades speech quality. Half-rate at 6.2 kbit/s has to be added to enable efficient operation in the Rate Set II framework. The resulting codec can operate in few CDMA2000-specific modes, and incorporates a mode that enables interoperability with systems using a AMR-WB codec.

Half-rate encoding is typically chosen in frames where the input speech signal is stationary. The bit savings, compared to full-rate, are achieved by updating encoding parameters less frequently or by using fewer bits to encode some of these encoding parameters. More specifically, in stationary voiced segments, the pitch information is encoded only once a frame, and fewer bits are used for representing the fixed codebook parameters and the linear prediction coefficients.

Since predictive VQ with MA prediction is typically applied to encode the linear prediction coefficients, an unnecessary increase in quantization noise can be observed in these linear prediction coefficients. MA prediction, as opposed to AR prediction, is used to increase the robustness to frame losses; however, in stationary frames the linear prediction coefficients evolve slowly so that using AR prediction in this particular case would have a smaller impact on error propagation in the case of lost frames. This can be seen by observing that, in the case of missing frames, most decoders apply a concealment procedure which essentially extrapolates the linear prediction coefficients of the last frame. If the missing frame is stationary voiced, this extrapolation produces values very similar to the actually transmitted, but not received, LP parameters. The reconstructed LP parameter vector is thus close to what would have been decoded if the frame had not been lost. In this specific case, therefore, using AR prediction in the quantization procedure of the linear prediction coefficients cannot have a very adverse effect on quantization error propagation.

SUMMARY OF THE INVENTION

According to the present invention, there is provided a method for quantizing linear prediction parameters in variable bit-rate sound signal coding, comprising receiving an input linear prediction parameter vector, classifying a sound signal frame corresponding to the input linear prediction parameter vector, computing a prediction vector, removing the computed prediction vector from the input linear prediction parameter vector to produce a prediction error vector, scaling the prediction error vector, and quantizing the scaled prediction error vector. Computing a prediction vector comprises selecting one of a plurality of prediction schemes in relation to the classification of the sound signal frame, and computing the prediction vector in accordance with the selected prediction scheme. Scaling the prediction error vector comprises selecting at least one of a plurality of scaling schemes in relation to the selected prediction scheme, and scaling the prediction error vector in accordance with the selected scaling scheme.

Also according to the present invention, there is provided a device for quantizing linear prediction parameters in variable bit-rate sound signal coding, comprising means for receiving an input linear prediction parameter vector, means for classifying a sound signal frame corresponding to the input linear prediction parameter vector, means for computing a prediction vector, means for removing the computed prediction vector from the input linear prediction parameter vector to produce a prediction error vector, means for scaling the prediction error vector, and means for quantizing the scaled prediction error vector. The means for computing a prediction vector comprises means for selecting one of a plurality of prediction schemes in relation to the classification of the sound signal frame, and means for computing the prediction vector in accordance with the selected prediction scheme. Also, the means for scaling the prediction error vector comprises means for selecting at least one of a plurality of scaling schemes in relation to the selected prediction scheme, and means for scaling the prediction error vector in accordance with the selected scaling scheme.

The present invention also relates to a device for quantizing linear prediction parameters in variable bit-rate sound signal coding, comprising an input for receiving an input linear prediction parameter vector, a classifier of a sound signal frame corresponding to the input linear prediction parameter vector, a calculator of a prediction vector, a subtractor for removing the computed prediction vector from the input linear prediction parameter vector to produce a prediction error vector, a scaling unit supplied with the prediction error vector, this unit scaling the prediction error vector, and a quantizer of the scaled prediction error vector. The prediction vector calculator comprises a selector of one of a plurality of prediction schemes in relation to the classification of the sound signal frame, to calculate the prediction vector in accordance with the selected prediction scheme. The scaling unit comprises a selector of at least one of a plurality of scaling schemes in relation to the selected prediction scheme, to scale the prediction error vector in accordance with the selected scaling scheme.

The present invention is further concerned with a method of dequantizing linear prediction parameters in variable bit-rate sound signal decoding, comprising receiving at least one quantization index, receiving information about classification of a sound signal frame corresponding to said at least one quantization index, recovering a prediction error vector by applying the at least one index to at least one quantization table, reconstructing a prediction vector, and producing a linear prediction parameter vector in response to the recovered prediction error vector and the reconstructed prediction vector. Reconstruction of a prediction vector comprises processing the recovered prediction error vector through one of a plurality of prediction schemes depending on the frame classification information.

The present invention still further relates to a device for dequantizing linear prediction parameters in variable bit-rate sound signal decoding, comprising means for receiving at least one quantization index, means for receiving information about classification of a sound signal frame corresponding to the at least one quantization index, means for recovering a prediction error vector by applying the at least one index to at least one quantization table, means for reconstructing a prediction vector, and means for producing a linear prediction parameter vector in response to the recovered prediction error vector and the reconstructed prediction vector. The prediction vector reconstructing means comprises means for processing the recovered prediction error vector through one of a plurality of prediction schemes depending on the frame classification information.

In accordance with a last aspect of the present invention, there is provided a device for dequantizing linear prediction parameters in variable bit-rate sound signal decoding, comprising means for receiving at least one quantization index, means for receiving information about classification of a sound signal frame corresponding to the at least one quantization index, at least one quantization table supplied with said at least one quantization index for recovering a prediction error vector, a prediction vector reconstructing unit, and a generator of a linear prediction parameter vector in response to the recovered prediction error vector and the reconstructed prediction vector. The prediction vector reconstructing unit comprises at least one predictor supplied with recovered prediction error vector for processing the recovered prediction error vector through one of a plurality of prediction schemes depending on the frame classification information.

The foregoing and other objects, advantages and features of the present invention will become more apparent upon reading of the following non restrictive description of illustrative embodiments thereof, given by way of example only with reference to the accompanying drawings.

DETAILED DESCRIPTION OF THE ILLUSTRATIVE EMBODIMENTS

Figure 1:
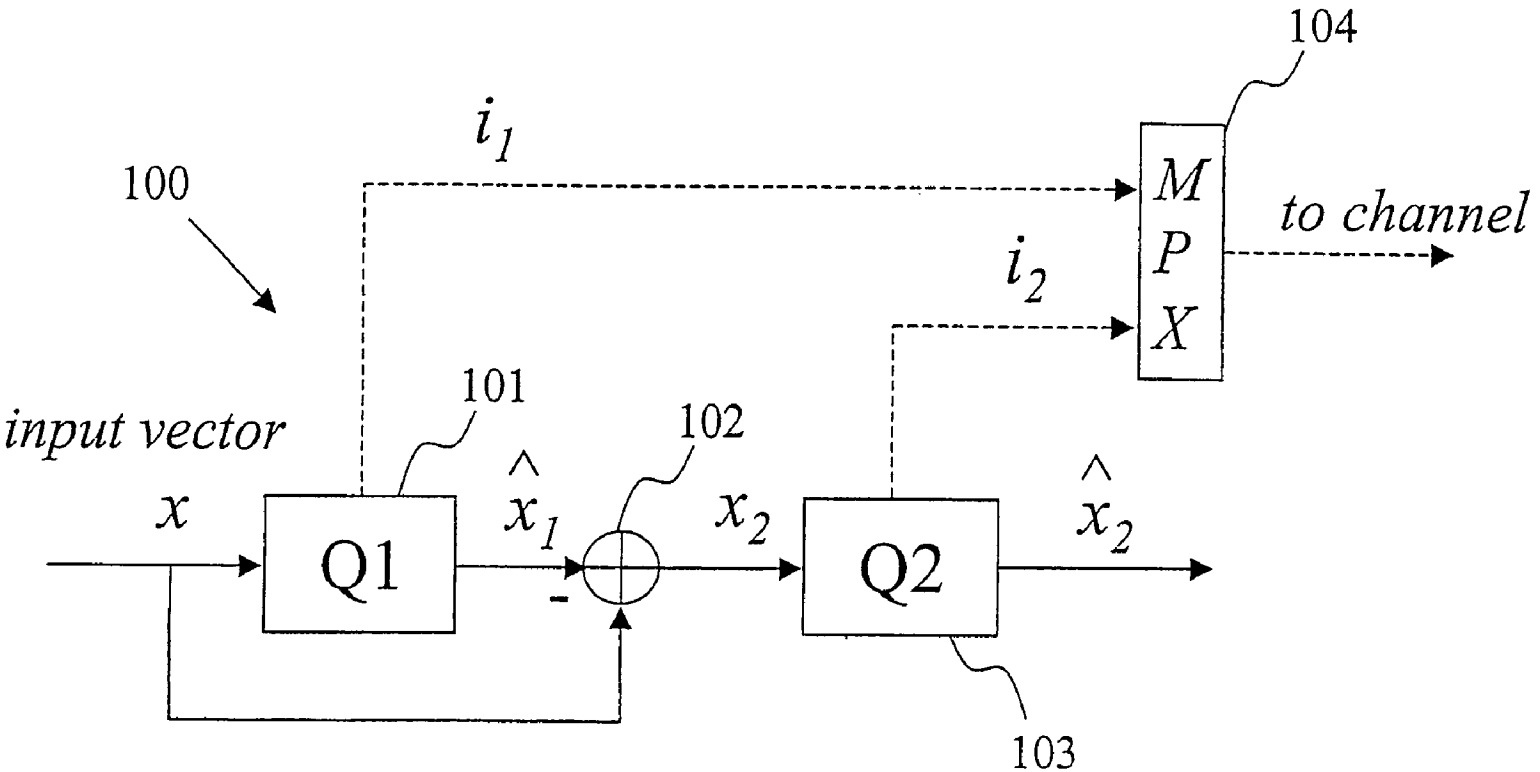
FIG. 1 is a schematic block diagram illustrating a non-limitative example of multi-stage vector quantizer.

Although the illustrative embodiments of the present invention will be described in the following description in relation to an application to a speech signal, it should be kept in mind that the present invention can also be applied to other types of sound signals.

Most recent speech coding techniques are based on linear prediction analysis such as CELP coding. The LP parameters are computed and quantized in frames of 10–30 ms. In the present illustrative embodiment, 20 ms frames are used and an LP analysis order of 16 is assumed. An example of computation of the LP parameters in a speech coding system is found in reference [ITU-T Recommendation G.722.2 "Wideband coding of speech at around 16 kbit/s using Adaptive Multi-Rate Wideband (AMR-WB)", Geneva, 2002]. In this illustrative example, the preprocessed speech signal is windowed and the autocorrelations of the windowed speech are computed. The Levinson-Durbin recursion is then used to compute the linear prediction coefficients $\alpha_i$, i=1, . . . ,M from the autocorrelations R(k), k=0, . . . ,M, where M is the prediction order.

The linear prediction coefficients $\alpha_i$ cannot be directly quantized for transmission to the decoder. The reason is that small quantization errors on the linear prediction coefficients can produce large spectral errors in the transfer function of the LP filter, and can even cause filter instabilities. Hence, a transformation is applied to the linear prediction coefficients $\alpha_i$ prior to quantization. The transformation yields what is called a representation of the linear prediction coefficients. After receiving the quantized, transformed linear prediction coefficients, the decoder can then apply the inverse transformation to obtain the quantized linear prediction coefficients. One widely used representation for the linear prediction coefficients $\alpha_i$ is the line spectral frequencies (LSF) also known as line spectral pairs (LSP). Details of the computation of the LSFs can be found in reference [ITU-T Recommendation G.729 "Coding of speech at 8 kbit/s using conjugate-structure algebraic-code-excited linear prediction (CS-ACELP)," Geneva, March 1996]. The LSFs consists of the poles of the polynomials:

$$P(z)=(A(z)+z^{-(M+1)}A(z^{-1}))/(1+z^{-1})$$

and $$Q(z)=(A(z)-z^{-(M+1)}A(z^{-1}))/(1-z^{-1})$$

For even values of M, each polynomial has M/2 conjugate roots on the unit circle ($e^{\pm j\omega i}$). Therefore, the polynomials can be written as:

$$P(z) = \prod_{i=1,3,\ldots,M-1} (1 - 2q_i z^{-1} + z^{-2}) \text{ and}$$

$$Q(z) = \prod_{i=2,4,\ldots,M} (1 - 2q_i z^{-1} + z^{-2}),$$

where $q_i=\cos(\omega_i)$ with $\omega_i$ being the line spectral frequencies (LSF) satisfying the ordering property $0<\omega_1<\omega_2< \ldots <\omega_M<\pi$. In this particular example, the LSFs constitutes the LP (linear prediction) parameters.

A similar representation is the immitance spectral pairs (ISP) or the immitance spectral frequencies (ISF), which has been used in the AMR-WB coding standard. Details of the computation of the ISFs can be found in reference [ITU-T Recommendation G.722.2 "Wideband coding of speech at around 16 kbit/s using Adaptive Multi-Rate Wideband (AMR-WB)", Geneva, 2002]. Other representations are also possible and have been used. Without loss of generality, the following description will consider the case of ISF representation as a non-restrictive illustrative example.

For an Mth order LP filter, where M is even, the ISPs are defined as the roots of the polynomials:

$$F_1(z)=A(z)+z^{-M}A(z^{-1})$$

and $$F_2(z)=(A(z)-z^{-M}A(z^{-1}))/(1-z^{-2})$$

Polynomials $F_1(z)$ and $F_2(z)$ have M/2 and M/2−1 conjugate roots on the unit circle ($e_{\pm j\omega}$), respectively. Therefore, the polynomials can be written as:

$$F_1(z) = (1 + a_M) \prod_{i=1,3,\ldots,M-1} (1 - 2q_i z^{-1} + z^{-2}) \text{ and}$$

$$F_2(z) = (1 + a_M) \prod_{i=2,4,\ldots,M-2} (1 - 2q_i z^{-1} + z^{-2})$$

where $q_i=\cos(\omega_i)$ with $\omega_i$ being the immittance spectral frequencies (ISF), and $\alpha_M$ is the last linear prediction coefficient. The ISFs satisfy the ordering property $0<\omega_1<\omega_2< \ldots <\omega_{M-1}<\pi$. In this particular example, the LSFs constitutes the LP (linear prediction) parameters. Thus the ISFs consist of M−1 frequencies in addition to the last linear prediction coefficients. In the present illustrative embodiment the ISFs are mapped into frequencies in the range 0 to $f_s/2$, where $f_s$ is the sampling frequency, using the following relation:

$$f_i = \frac{f_s}{2\pi}\arccos(q_i),\ i = 1, \ldots, M-1 \text{ and}$$

$$f_M = \frac{f_s}{4\pi}\arccos(a_M)$$

LSFs and ISFs (LP parameters) have been widely used due to several properties which make them suitable for quantization purposes. Among these properties are the well defined dynamic range, their smooth evolution resulting in strong inter and intra-frame correlations, and the existence of the ordering property which guarantees the stability of the quantized LP filter.

In this document, the term "LP parameter" is used to refer to any representation of LP coefficients, e.g. LSF, ISF, Mean-removed LSF, or mean-removed ISF.

Figure 7:
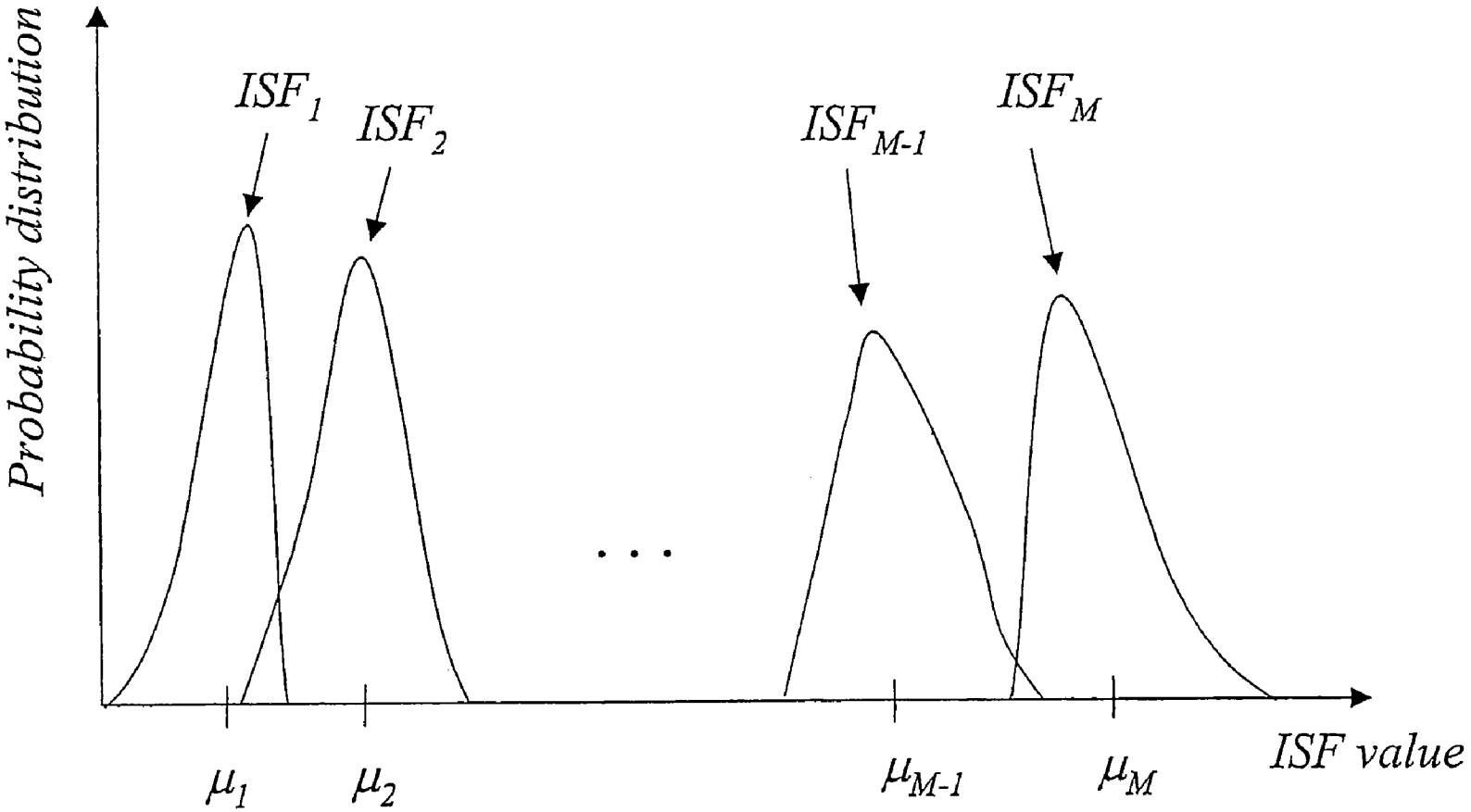
FIG. 7 is a non-restrictive illustrative example of a distribution of ISFs over frequency, wherein each distribution is a function of the probability to find an ISF at a given position in the ISF vector.

The main properties of ISFs (LP (linear prediction) parameters) will now be described in order to understand the quantization approaches used. FIG. 7 shows a typical example of the probability distribution function (PDF) of ISF coefficients. Each curve represents the PDF of an individual ISF coefficient. The mean of each distribution is shown on the horizontal axis ($\mu_k$). For example, the curve for $ISF_1$ indicates all values, with their probability of occurring, that can be taken by the first ISF coefficient in a frame. The curve for $ISF_2$ indicates all values, with their probability of occurring, that can be taken by the second ISF coefficient in a frame, and so on. The PDF function is typically obtained by applying a histogram to the values taken by a given coefficient as observed through several consecutive frames. We see that each ISF coefficient occupies a restricted interval over all possible ISF values. This effectively reduces the space that the quantizer has to cover and increases the bit-rate efficiency. It is also important to note that, while the PDFs of ISF coefficients can overlap, ISF coefficients in a given frame are always ordered ($ISF_{k+1}-ISF_k>0$, where k is the position of the ISF coefficient within the vector of ISF coefficients).

Figure 8:
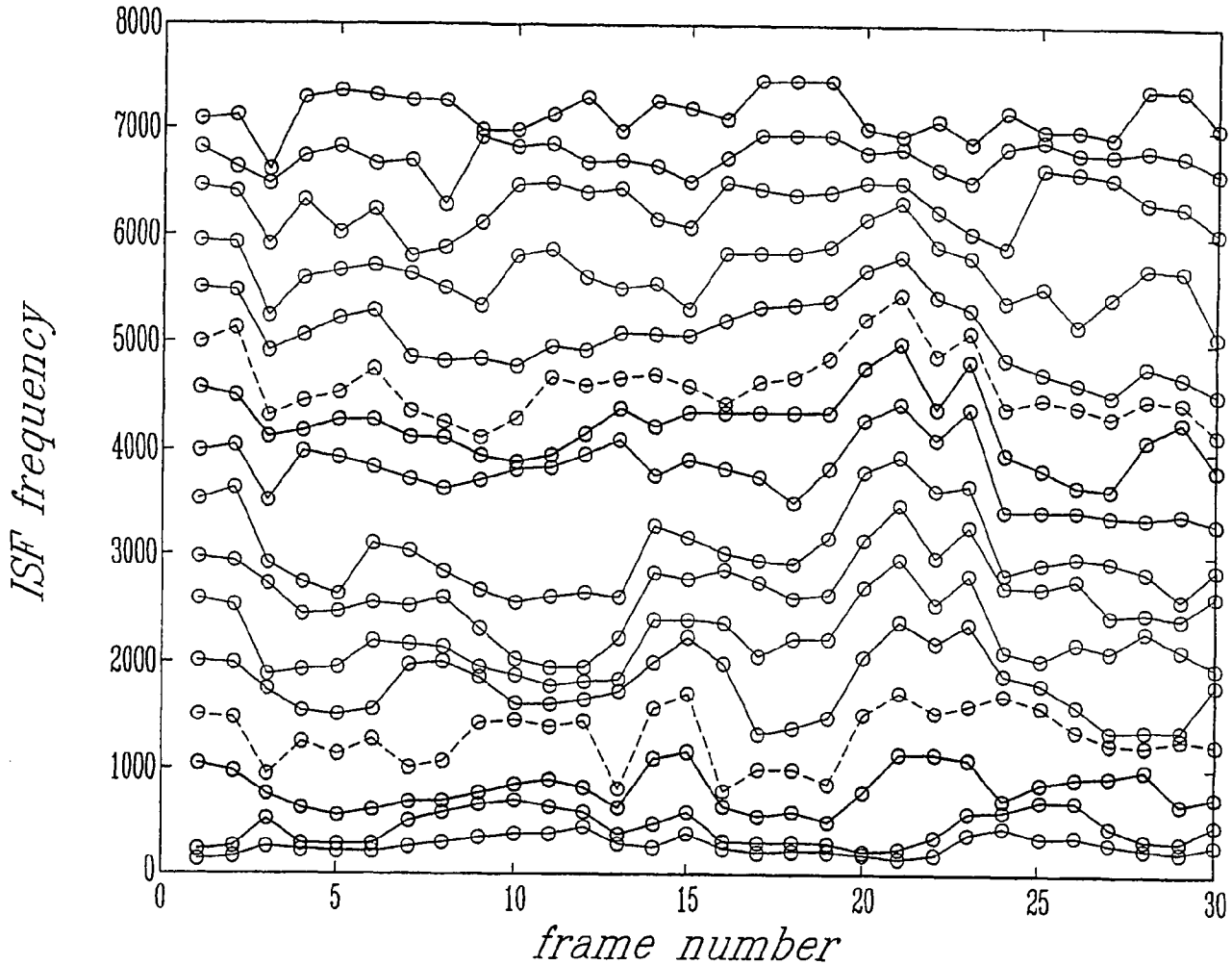
FIG. 8 is a graph showing a typical example of evolution of ISF parameters through successive speech frames.

With frame lengths of 10 to 30 ms typical in a speech encoder, ISF coefficients exhibit interframe correlation. FIG. 8 illustrates how ISF coefficients evolve across frames in a speech signal. FIG. 8 was obtained by performing LP analysis over 30 consecutive frames of 20 ms in a speech segment comprising both voiced and unvoiced frames. The LP coefficients (16 per frame) were transformed into ISF coefficients. FIG. 8 shows that the lines never cross each other, which means that ISFs are always ordered. FIG. 8 also shows that ISF coefficients typically evolve slowly, compared to the frame rate. This means in practice that predictive quantization can be applied to reduce the quantization error.

Figure 3:
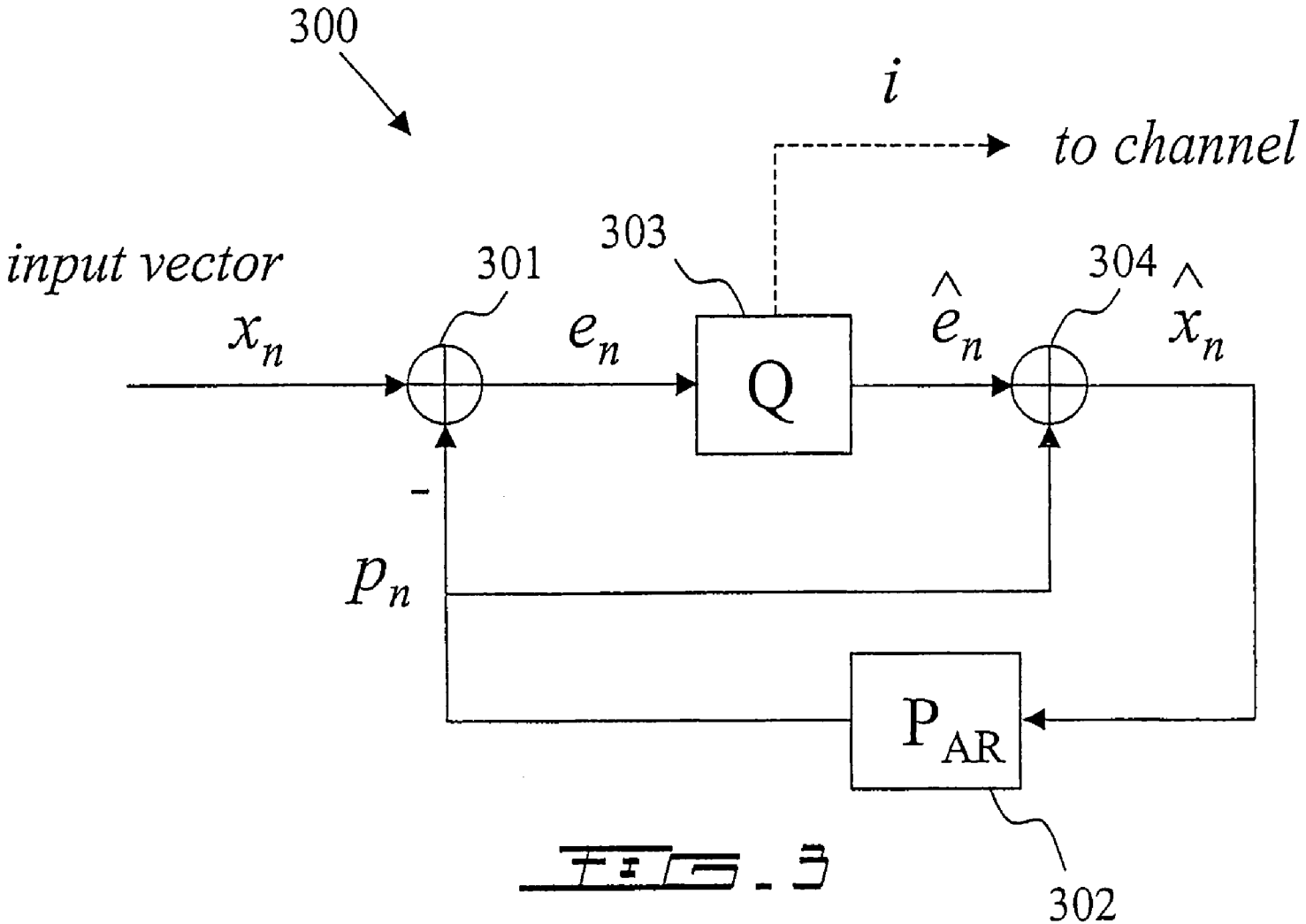
FIG. 3 is a schematic block diagram illustrating a non-limitative example of predictive vector quantizer using autoregressive (AR) prediction.

FIG. 3 illustrates an example of predictive vector quantizer 300 using autoregressive (AR) prediction. As illustrated in FIG. 3, a prediction error vector $e_n$ is first obtained by subtracting (Processor 301) a prediction vector $p_n$ from the input LP parameter vector to be quantized $x_n$. The symbol n here refers to the frame index in time. The prediction vector $p_n$ is computed by a predictor P (Processor 302) using the past quantized LP parameter vectors $\hat{x}_{n-1}$, $\hat{x}_{n-2}$, etc. The prediction error vector $e_n$ is then quantized (Processor 303) to produce an index i for transmission for example through a channel and a quantized prediction error vector $\hat{e}_n$. The total quantized LP parameter vector $\hat{x}_n$ is obtained by adding (Processor 304) the quantized prediction error vector $\hat{e}_n$ and the prediction vector $p_n$. A general form of the predictor P (Processor 302) is:

$$p_n=A_1\hat{x}_{n-1}+A_2\hat{x}_{n-2}+\ldots+A_K\hat{x}_{n-K}$$

where $A_k$ are prediction matrices of dimension M×M and K is the predictor order. A simple form for the predictor P (Processor 302) is the use of first order prediction:

$$p_n=A\hat{x}_{n-1} \tag{2}$$

where A is a prediction matrix of dimension M×M, where M is the dimension of LP parameter vector $x_n$. A simple form of the prediction matrix A is a diagonal matrix with diagonal elements $\alpha_1, \alpha_2, \ldots, \alpha_M$, where $\alpha_1$ are prediction factors for individual LP parameters. If the same factor $\alpha$ is used for all LP parameters then equation 2 reduces to:

$$p_n=\alpha\hat{x}_{n-1} \tag{3}$$

Using the simple prediction form of Equation (3), then in FIG. 3, the quantized LP parameter vector $\hat{x}_n$ is given by the following autoregressive (AR) relation:

$$\hat{x}_n=\hat{e}_n+\alpha\hat{x}_{n-1} \tag{4}$$

The recursive form of Equation (4) implies that, when using an AR predictive quantizer 300 of the form as illustrated in FIG. 3, channel errors will propagate across several frames. This can be seen more clearly if Equation (4) is written in the following mathematically equivalent form:

$$\hat{x}_n = \hat{e}_n + \sum_{k=1}^{\infty} \alpha^k \hat{e}_{n-k} \tag{5}$$

This form clearly shows that in principle each past decoded prediction error vector $\hat{e}_{n-k}$ contributes to the value of the quantized LP parameter vector $\hat{x}_n$. Hence, in the case of channel errors, which would modify the value of $\hat{e}_n$ received by the decoder relative to what was sent by the encoder, the decoded vector $\hat{x}_n$ obtained in Equation (4) would not be the same at the decoder and at the encoder. Because of the recursive nature of the predictor P, this encoder-decoder mismatch will propagate in the future and affect the next vectors $\hat{x}_{n+1}$, $\hat{x}_{n+2}$, etc., even if there are no channel errors in the later frames. Therefore, predictive vector quantization is not robust to channel errors, especially when the prediction factors are high ($\alpha$ close to 1 in Equations (4) and (5)).

To alleviate this propagation problem, moving average (MA) prediction can be used instead of AR prediction. In MA prediction, the infinite series of Equation (5) is truncated to a finite number of terms. The idea is to approximate the autoregressive form of predictor P in Equation (4) by using a small number of terms in Equation (5). Note that the weights in the summation can be modified to better approximate the predictor P of Equation (4).

Figure 4:
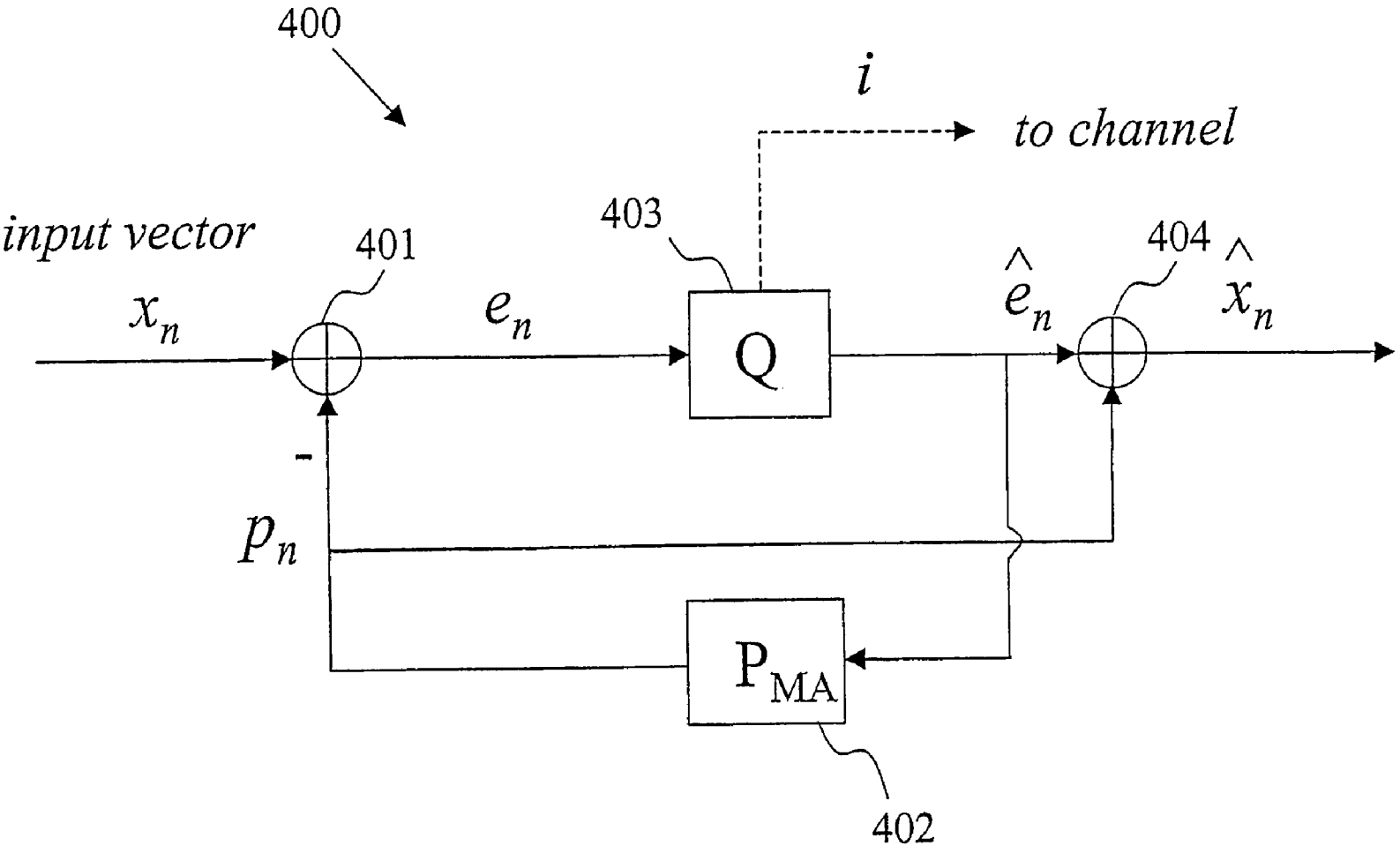
FIG. 4 is a schematic block diagram illustrating a non-limitative example of predictive vector quantizer using moving average (MA) prediction.

A non-limitative example of MA predictive vector quantizer 400 is shown in FIG. 4, wherein processors 401, 402, 403 and 404 correspond to processors 301, 302, 303 and 304, respectively. A general form of the predictor P (Processor 402) is:

$$p_n=B_1\hat{e}_{n-1}+B_2\hat{e}_{n-2}+\ldots+B_K\hat{e}_{n-K}$$

where $B_k$ are prediction matrices of dimension M×M and K is the predictor order. It should be noted that in MA prediction, transmission errors propagate only into next K frames.

A simple form for the predictor P (Processor 402) is to use first order prediction:

$$p_n=B\hat{e}_{n-1} \tag{6}$$

where B is a prediction matrix of dimension M×M, where M is the dimension of LP parameter vector. A simple form of the prediction matrix is a diagonal matrix with diagonal elements $\beta_1, \beta_2, \ldots, \beta_M$, where $\beta_1$ are prediction factors for individual LP parameters. If the same factor $\beta$ is used for all LP parameters then Equation (6) reduces to:

$$p_n=\beta\hat{x}_{n-1} \tag{7}$$

Using the simple prediction form of Equation (7), then in FIG. 4, the quantized LP parameter vector $\hat{x}_n$ is given by the following moving average (MA) relation:

$$\hat{x}_n=\hat{e}_n+\beta\hat{e}_{n-1} \tag{8}$$

In the illustrative example of predictive vector quantizer 400 using MA prediction as shown in FIG. 4, the predictor memory (in Processor 402) is formed by the past decoded prediction error vectors $\hat{e}_{n-1}$, $\hat{e}_{n-2}$, etc. Hence, the maximum number of frames over which a channel error can propagate is the order of the predictor P (Processor 402). In the illustrative predictor example of Equation (8), a $1^{st}$ order prediction is used so that the MA prediction error can only propagate over one frame only.

While more robust to transmission errors than AR prediction, MA prediction does not achieve the same prediction gain for a given prediction order. The prediction error has consequently a greater dynamic range, and can require more bits to achieve the same coding gain than with AR predictive quantization. The compromise is thus robustness to channel errors versus coding gain at a given bit rate.

In source-controlled variable bit rate (VBR) coding, the encoder operates at several bit rates, and a rate selection module is used to determine the bit rate used for encoding each speech frame based on the nature of the speech frame, for example voiced, unvoiced, transient, background noise. The nature of the speech frame, for example voiced, unvoiced, transient, background noise, etc., can be determined in the same manner as for CDMA VBR. The goal is to attain the best speech quality at a given average bit rate, also referred to as average data rate (ADR). As an illustrative example, in CDMA systems, for example CDMA-one and CDMA2000, typically 4 bit rates are used and are referred to as full-rate (FR), half-rate (HR), quarter-rate (QR), and eighth-rate (ER). In this CDMA system, two sets of rates are supported and are referred to as Rate Set I and Rate Set II. In Rate Set II, a variable-rate encoder with rate selection mechanism operates at source-coding bit rates of 13.3 (FR), 6.2 (HR), 2.7 (QR), and 1.0 (ER) kbit/s.

In VBR coding, a classification and rate selection mechanism is used to classify the speech frame according to its nature (voiced, unvoiced, transient, noise, etc.) and selects the bit rate needed to encode the frame according to the classification and the required average data rate (ADR). Half-rate encoding is typically chosen in frames where the input speech signal is stationary. The bit savings compared to the full-rate are achieved by updating encoder parameters less frequently or by using fewer bits to encode some parameters. Further, these frames exhibit a strong correlation which can be exploited to reduce the bit rate. More specifically, in stationary voiced segments, the pitch information is encoded only once in a frame, and fewer bits are used for the fixed codebook and the LP coefficients. In unvoiced frames, no pitch prediction is needed and the excitation can be modeled with small codebooks in HR or random noise in QR.

Since predictive VQ with MA prediction is typically applied to encode the LP parameters, this results in an unnecessary increase in quantization noise. MA prediction, as opposed to AR prediction, is used to increase the robustness to frame losses; however, in stationary frames the LP parameters evolve slowly so that using AR prediction in this case would have a smaller impact on error propagation in the case of lost frames. This is detected by observing that, in the case of missing frames, most decoders apply a concealment procedure which essentially extrapolates the LP parameters of the last frame. If the missing frame is stationary voiced, this extrapolation produces values very similar to the actually transmitted, but not received LP parameters. The reconstructed LP parameter vector is thus close to what would have been decoded if the frame had not been lost. In that specific case, using AR prediction in the quantization procedure of the LP coefficients cannot have a very adverse effect on quantization error propagation.

Thus, according to a non-restrictive illustrative embodiment of the present invention, a predictive VQ method for LP parameters is disclosed whereby the predictor is switched between MA and AR prediction according to the nature of the speech frame being processed. More specifically, in transient and non-stationary frames MA prediction is used while in stationary frames AR prediction is used. Moreover, since AR prediction results in a prediction error vector $e_n$ with a smaller dynamic range than MA prediction, it is not efficient to use the same quantization tables for both types of prediction. To overcome this problem, the prediction error vector after AR prediction is properly scaled so that it can be quantized using the same quantization tables as in the MA prediction case. When multistage VQ is used to quantize the prediction error vector, the first stage can be used for both types of prediction after properly scaling the AR prediction error vector. Since it is sufficient to use split VQ in the second stage which doesn't require large memory, quantization tables of this second stage can be trained and designed separately for both types of prediction. Of course, instead of designing the quantization tables of the first stage with MA prediction and scaling the AR prediction error vector, the opposite is also valid, that is, the first stage can be designed for AR prediction and the MA prediction error vector is scaled prior to quantization.

Thus, according to a non-restrictive illustrative embodiment of the present invention, a predictive vector quantization method is also disclosed for quantizing LP parameters in a variable bit rate speech codec whereby the predictor P is switched between MA and AR prediction according to classification information regarding the nature of the speech frame being processed, and whereby the prediction error vector is properly scaled such that the same first stage quantization tables in a multistage VQ of the prediction error can be used for both types of prediction.

EXAMPLE 1

FIG. 1 shows a non-limitative example of a two-stage vector quantizer 100. An input vector x is first quantized with the quantizer Q1 (Processor 101) to produce a quantized vector $\hat{x}_1$ and a quantization index $i_1$. The difference between the input vector x and first stage quantized vector $\hat{x}_1$ is computed (Processor 102) to produce the error vector $x_2$ further quantized with a second stage VQ (Processor 103) to produce the quantized second stage error vector $\hat{x}_2$ with quantization index $i_2$. The indices of $i_1$ and $i_2$ are transmitted (Processor 104) through a channel and the quantized vector $\hat{x}$ is reconstructed at the decoder as $\hat{x}=\hat{x}_1+\hat{x}_2$.

Figure 2:
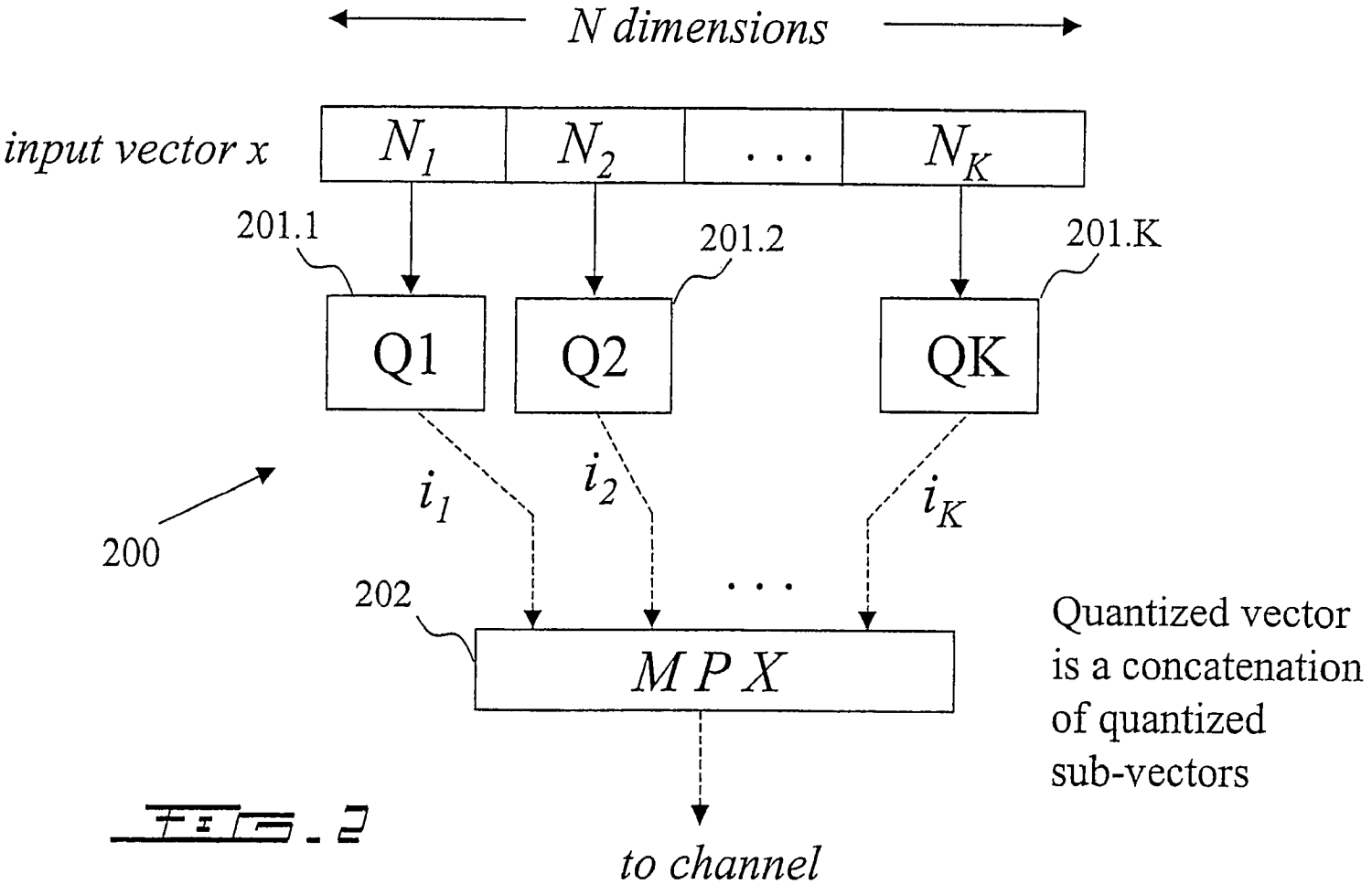
FIG. 2 is a schematic block diagram illustrating a non-limitative example of split-vector vector quantizer.

FIG. 2 shows an illustrative example of split vector quantizer 200. An input vector x of dimension M is split into K subvectors of dimensions $N_1, N_2, \ldots, N_K$, and quantized with vector quantizers $Q_1, Q_2, \ldots, Q_K$, respectively (Processors 201.1, 201.2 . . . 201.K). The quantized subvectors $\hat{y}_1, \hat{y}_2, \ldots, \hat{y}_K$, with quantization indices $i_1$, $i_2$, and $i_K$ are found. The quantization indices are transmitted (Processor 202) through a channel and the quantized vector $\hat{x}$ is reconstructed by simple concatenation of quantized subvectors.

An efficient approach for vector quantization is to combine both multi-stage and split VQ which results in a good trade-off between quality and complexity. In a first illustrative example, a two-stage VQ can be used whereby the second stage error vector $\hat{e}_2$ is split into several subvectors and quantized with second stage quantizers $Q_{21}, Q_{22}, \ldots,$ $Q_{2K}$, respectively. In an second illustrative example, the input vector can be split into two subvectors, then each subvector is quantized with two-stage VQ using further split in the second stage as in the first illustrative example.

Figure 5:
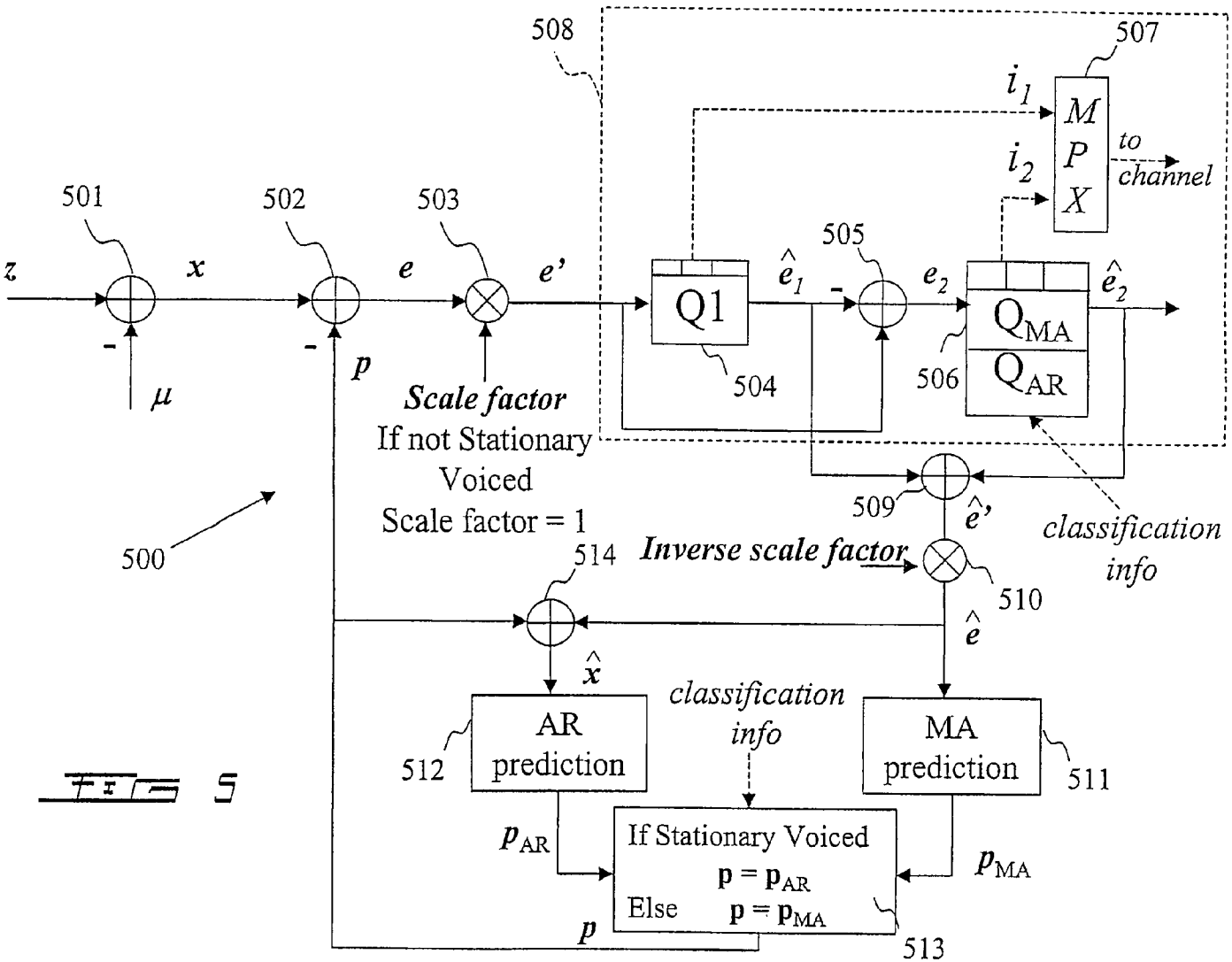
FIG. 5 is a schematic block diagram of an example of switched predictive vector quantizer at the encoder, according to a non-restrictive illustrative embodiment of present invention.

FIG. 5 is a schematic block diagram illustrating a non-limitative example of switched predictive vector quantizer 500 according to the present invention. Firstly, a vector of mean LP parameters μ is removed from an input LP parameter vector z to produce the mean-removed LP parameter vector x (Processor 501). As indicated in the foregoing description, the LP parameter vectors can be vectors of LSF parameters, ISF parameters, or any other relevant LP parameter representation. Removing the mean LP parameter vector μ from the input LP parameter vector z is optional but results in improved prediction performance. If Processor 501 is disabled then the mean-removed LP parameter vector x will be the same as the input LP parameter vector z. It should be noted here that the frame index n used in FIGS. 3 and 4 has been dropped here for the purpose of simplification. The prediction vector p is then computed and removed from the mean-removed LP parameter vector x to produce the prediction error vector e (Processor 502). Then, based on frame classification information, if the frame corresponding to the input LP parameter vector z is stationary voiced then AR prediction is used and the error vector e is scaled by a certain factor (Processor 503) to obtain the scaled prediction error vector e'. If the frame is not stationary voiced, MA prediction is used and the scaling factor (Processor 503) is equal to 1. Again, classification of the frame, for example voiced, unvoiced, transient, background noise, etc., can be determined, for example, in the same manner as for CDMA VBR. The scaling factor is typically larger than 1 and results in upscaling the dynamic range of the prediction error vector so that it can be quantized with a quantizer designed for MA prediction. The value of the scaling factor depends on the coefficients used for MA and AR prediction. Non-restrictive typical values are: MA prediction coefficient $\beta=0.33$, AR prediction coefficient $\alpha=0.65$, and scaling factor=1.25. If the quantizer is designed for AR prediction then an opposite operation will be performed: the prediction error vector for MA prediction will be scaled and the scaling factor will be smaller than 1.

The scaled prediction error vector e' is then vector quantized (Processor 508) to produce a quantized scaled prediction error vector e'. In the example of FIG. 5, processor 508 consists of a two-stage vector quantizer where split VQ is used in both stages and wherein the vector quantization tables of the first stage are the same for both MA and AR prediction. The two-stage vector quantizer 508 consists of processors 504, 505, 506, 507, and 509. In the first-stage quantizer Q1, the scaled prediction error vector e' is quantized to produce a first-stage quantized prediction error vector $\hat{e}_1$ (Processor 504). This vector $\hat{e}_1$ is removed from the scaled prediction error vector e' (Processor 505) to produce a second-stage prediction error vector $e_2$. This second-stage prediction error vector $e_2$ is then quantized (Processor 506) by either a second-stage vector quantizer $Q_{MA}$ or a second-stage vector quantizer $Q_{AR}$ to produce a second-stage quantized prediction error vector $\hat{e}_2$. The choice between the second-stage vector quantizers $Q_{MA}$ and $Q_{AR}$ depends on the frame classification information (for example, as indicated hereinabove, AR if the frame is stationary voiced and MA if the frame is not stationary voiced). The quantized scaled prediction error vector ê' is reconstructed (Processor 509) by the summation of the quantized prediction error vectors $\hat{e}_1$ and $\hat{e}_2$ from the two stages: $\hat{e}'=\hat{e}_1+\hat{e}_2$. Finally, scaling inverse to that of processor 503 is applied to the quantized scaled prediction error vector ê' (Processor 510) to produce the quantized prediction error vector ê. In the present illustrative example, the vector dimension is 16, and split VQ is used in both stages. The quantization indices $i_1$ and $i_2$ from quantizer Q1 and quantizer $Q_{MA}$ or $Q_{AR}$ are multiplexed and transmitted through a communication channel (Processor 507).

The prediction vector p is computed in either an MA predictor (Processor 511) or an AR predictor (Processor 512) depending on the frame classification information (for example, as indicated hereinabove, AR if the frame is stationary voiced and MA if the frame is not stationary voiced, selection made by Processor 513). If the frame is stationary voiced then the prediction vector is equal to the output of the AR predictor 512. Otherwise the prediction vector is equal to the output of the MA predictor 511. As explained hereinabove the MA predictor 511 operates on the quantized prediction error vectors from previous frames while the AR predictor 512 operates on the quantized input LP parameter vectors from previous frames. The quantized input LP parameter vector (mean-removed) is constructed by adding the quantized prediction error vector ê to the prediction vector p (Processor 514): $\hat{x}=\hat{e}+p$.

Figure 6:
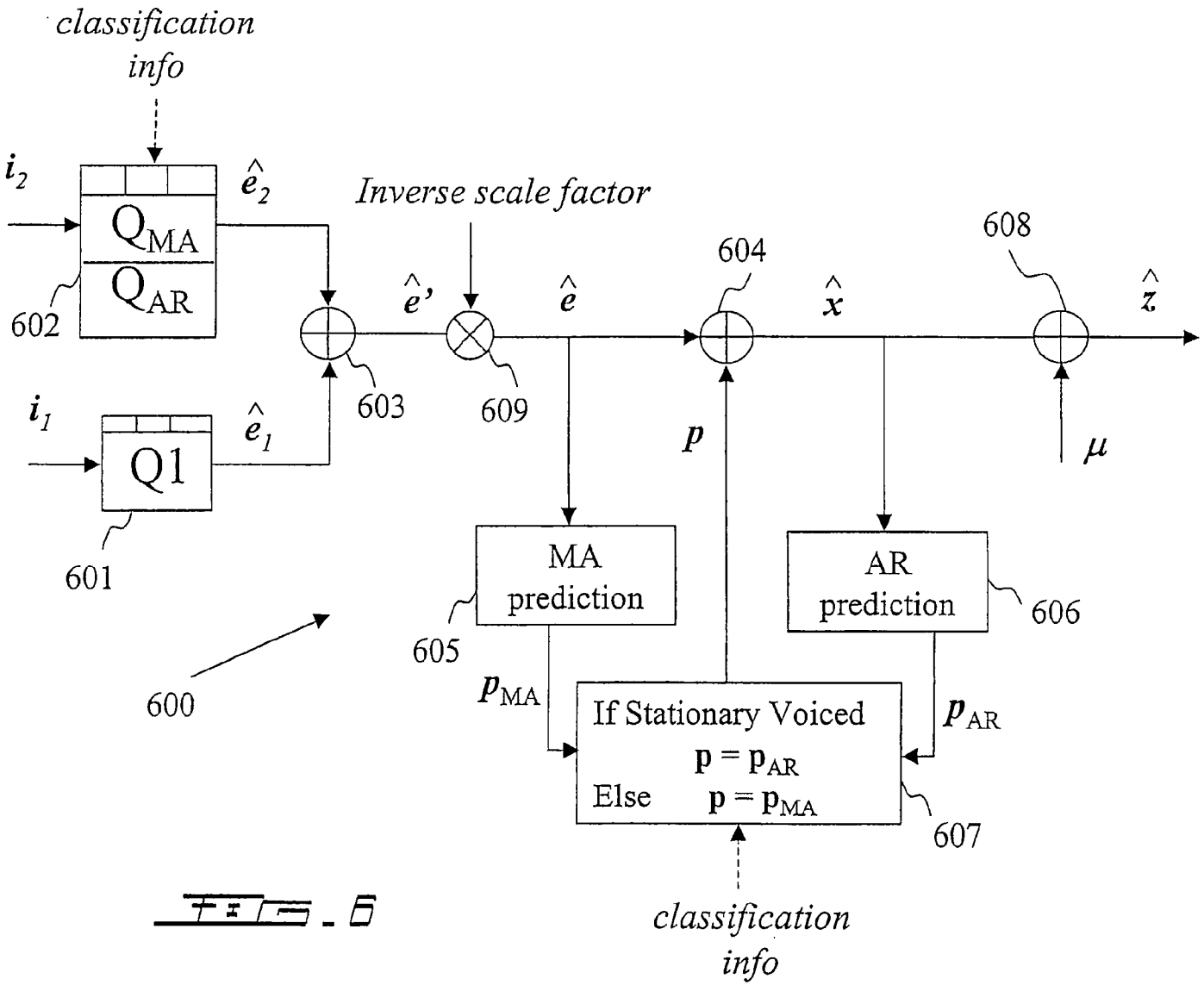
FIG. 6 is a schematic block diagram of an example of switched predictive vector quantizer at the decoder, according to a non-restrictive illustrative embodiment of present invention.

FIG. 6 is a schematic block diagram showing an illustrative embodiment of a switched predictive vector quantizer 600 at the decoder according to the present invention. At the decoder side, the received sets of quantization indices $i_1$ and $i_2$ are used by the quantization tables (Processors 601 and 602) to produce the first-stage and second-stage quantized prediction error vectors $\hat{e}_1$ and $\hat{e}_2$. Note that the second-stage quantization (Processor 602) consists of two sets of tables for MA and AR prediction as described hereinabove with reference to the encoder side of FIG. 5. The scaled prediction error vector is then reconstructed in Processor 603 by summing the quantized prediction error vectors from the two stages: $\hat{e}'=\hat{e}_1+\hat{e}_2$. Inverse scaling is applied in Processor 609 to produce the quantized prediction error vector ê. Note that the inverse scaling is a function of the received frame classification information and corresponds to the inverse of the scaling performed by processor 503 of FIG. 5. The quantized, mean-removed input LP parameter vector $\hat{x}$ is then reconstructed in Processor 604 by adding the prediction vector p to the quantized prediction error vector ê: $\hat{x}=\hat{e}+p$. In case the vector of mean LP parameters μ has been removed at the encoder side, it is added in Processor 608 to produce the quantized input LP parameter vector $\hat{z}$. It should be noted that as in the case of the encoder side of FIG. 5, the prediction vector p is either the output of the MA predictor 605 or the AR predictor 606 depending on the frame classification information; this selection is made in accordance with the logic of Processor 607 in response to the frame classification information. More specifically, if the frame is stationary voiced then the prediction vector p is equal to the output of the AR predictor 606. Otherwise the prediction vector p is equal to the output of the MA predictor 605.

Of course, despite the fact that only the output of either the MA pedictor or the AR predictor is used in a certain frame, the memories of both predictors will be updated every frame, assuming that either MA or AR prediction can be used in the next frame. This is valid for both the encoder and decoder sides.

In order to optimize the encoding gain, some vectors of the first stage, designed for MA prediction, can be replaced by new vectors designed for AR prediction. In a non-restrictive illustrative embodiment, the first stage codebook size is 256, and has the same content as in the AMR-WB standard at 12.65 kbit/s, and 28 vectors are replaced in the first stage codebook when using AR prediction. An extended, first stage codebook is thus formed as follows: first, the 28 first-stage vectors less used when applying AR prediction but usable for MA prediction are placed at the beginning of a table, then the remaining 256−28=228 first-stage vectors usable for both AR and MA prediction are appended in the table, and finally 28 new vectors usable for AR prediction are put at the end of the table. The table length is thus 256+28=284 vectors. When using MA prediction, the first 256 vectors of the table are used in the first stage; when using AR prediction the last 256 vectors of the table are used. To ensure interoperability with the AMR-WB standard, a table is used which contains the mapping between the position of a first stage vector in this new codebook, and its original position in the AMR-WB first stage codebook.

To summarize, the above described non-restrictive illustrative embodiments of the present invention, described in relation to FIGS. 5 and 6, presents the following features:

- Switched AR/MA prediction is used depending on the encoding mode of the variable rate encoder, itself depending on the nature of the current speech frame.
- Essentially the same first stage quantizer is used whether AR or MA prediction is applied, which results in memory savings. In a non-restrictive illustrative embodiment, $16^{th}$ order LP prediction is used and the LP parameters are represented in the ISF domain. The first stage codebook is the same as the one used in the 12.65 kbit/s mode of the AMR-WB encoder where the codebook was designed using MA prediction (The 16 dimension LP parameter vector is split by 2 to obtain two subvectors with dimension 7 and 9, and in the first stage of quantization, two 256-entry codebooks are used).
- Instead of MA prediction, AR prediction is used in stationary modes, specifically half-rate voiced mode; otherwise, MA prediction is used.
- In the case of AR prediction, the first stage of the quantizer is the same as the MA prediction case. However, the second stage can be properly designed and trained for AR prediction.
- To take into account this switching in the predictor mode, the memories of both MA and AR predictors are updated every frame, assuming both MA or AR prediction can be used for the next frame.
- Further, to optimize the encoding gain, some vectors of the first stage, designed for MA prediction, can be replaced by new vectors designed for AR prediction. According to this non-restrictive illustrative embodiment, 28 vectors are replaced in the first stage codebook when using AR prediction.
- An enlarged, first stage codebook can thus be formed as follows: first, the 28 first stage vectors less used when applying AR prediction are placed at the beginning of a table, then the remaining 256−28=228 first stage vectors are appended in the table, and finally 28 new vectors are put at the end of the table. The table length is thus 256+28=284 vectors. When using MA prediction, the first 256 vectors of the table are used in the first stage; when using AR prediction the last 256 vectors of the table are used.
- To ensure interoperability with the AMR-WB standard, a table is used which contains the mapping between the position of a first stage vector in this new codebook, and its original position in the AMR-WB first stage codebook.
- Since AR prediction achieves lower prediction error energy than MA prediction when used on stationary signals, a scaling factor is applied to the prediction error. In a non-restrictive illustrative embodiment, the scaling factor is 1 when MA prediction is used, and 1/0.8 when AR prediction is used. This increases the AR prediction error to a dynamic equivalent to the MA prediction error. Hence, the same quantizer can be used for both MA and AR prediction in the first stage.

Although the present invention has been described in the foregoing description in relation to non-restrictive illustrative embodiments thereof, these embodiments can be modified at will, within the scope of the appended claims, without departing from the nature and scope of the present invention.

What is claimed is:

1. Apparatus comprising a switched predictive vector quantizer having an input for receiving an input Linear Prediction (LP) parameter vector z and a first processor for removing a vector of mean LP parameters μ from the input LP parameter vector z to produce a mean-removed LP parameter vector x, a second processor for determining a prediction vector p and a third processor for removing the prediction vector p from the mean-removed LP parameter vector x to produce a prediction error vector e, further comprising a fourth processor responsive to frame classification information such that if a frame corresponding to the input LP parameter vector z is stationary voiced then autoregressive (AR) prediction is used and the error vector e is scaled by a certain factor to obtain a scaled prediction error vector e', whereas if the frame is not stationary voiced moving average (MA) prediction is used and the scaling factor is equal to one; further comprising a fifth processor coupled to receive the scaled prediction error vector e' and operable to vector quantize the scaled prediction error vector e' to produce a quantized scaled prediction error vector ê' and a sixth processor coupled to receive the quantized scaled prediction error vector ê' for applying a scaling inverse to that applied by said fourth processor to the quantized scaled prediction error vector ê' to produce the quantized prediction error vector ê; where said second processor determines the prediction vector p in one of an MA predictor or an AR predictor depending on the frame classification information such that if the frame is stationary voiced then the prediction vector p is equal to the output of the AR predictor else the prediction vector p is equal to the output of the MA predictor, where said MA predictor operates on quantized prediction error vectors from previous frames and said AR predictor operates on quantized input LP parameter vectors from previous frames; and where the quantized input LP parameter vector (mean-removed) is constructed by adding the quantized prediction error vector ê to the prediction vector p: $\hat{x}=\hat{e}+p$.

2. A method for quantizing linear prediction parameters in variable bit-rate sound signal coding, comprising:

receiving an input linear prediction parameter vector;

classifying a sound signal frame corresponding to the input linear prediction parameter vector;

computing a prediction vector;

removing the computed prediction vector from the input linear prediction parameter vector to produce a prediction error vector;

scaling the prediction error vector;

quantizing the scaled prediction error vector;

wherein:

computing a prediction vector comprises selecting one of a plurality of prediction schemes in relation to the classification of the sound signal frame, and computing the prediction vector in accordance with the selected prediction scheme; and scaling the prediction error vector comprises selecting at least one of a plurality of scaling scheme in relation to the selected prediction scheme, and scaling the prediction error vector in accordance with the selected scaling scheme.

3. A method for quantizing linear prediction parameters according to claim 2, wherein quantizing the prediction error vector comprises:

processing the prediction error vector through at least one quantizer using the selected prediction scheme.

4. A method for quantizing linear prediction parameters according to claim 3, wherein:

the plurality of prediction schemes comprises moving-average prediction and auto-regressive prediction;

quantizing the prediction error vector comprises:

processing the prediction error vector through a two-stage vector quantizer comprising a first-stage codebook itself comprising, in sequence:

a first group of vectors usable when applying moving-average prediction and placed at the beginning of a table;

a second group of vectors usable when applying either moving-average and auto-regressive prediction and placed in the table intermediate the first group of vectors and a third group of vectors;

the third group of vectors usable when applying auto-regressive prediction and placed at the end of the table;

processing the prediction error vector through at least one quantizer using the selected prediction scheme comprises:

when the selected prediction scheme is moving-average prediction, processing the prediction error vector through the first and second groups of vectors of the table; and when the selected prediction scheme is auto-regressive prediction, processing the prediction error vector through the second and third groups of vectors.

5. A method for quantizing linear prediction parameters according to claim 4, wherein, to ensure interoperability with the AMR-WB standard, mapping between the position of a first-stage vector in the table of the first-stage codebook and an original position of the first-stage vector in an AMR-WB first-stage codebook is made through a mapping table.

6. A method for quantizing linear prediction parameters according to claim 2, wherein:

the plurality of prediction schemes comprises moving-average prediction and auto-regressive prediction.

7. A method for quantizing linear prediction parameters according to claim 6, wherein:

quantizing the prediction error vector comprises processing the prediction error vector through a two-stage vector quantization process comprising first and second stages; and processing the prediction error vector through a two-stage vector quantization process comprises applying the prediction error vector to vector quantization tables of the first stage, which are the same for both moving-average and auto-regressive prediction.

8. A method for quantizing linear prediction parameters according to claim 2, further comprising:

producing a vector of mean linear prediction parameters; and removing the vector of mean linear prediction parameters from the input linear prediction parameter vector to produce a mean-removed linear prediction parameter vector.

9. A method for quantizing linear prediction parameters according to claim 2, wherein:

classifying the sound signal frame comprises determining that the sound signal frame is a stationary voiced frame;

selecting one of a plurality of prediction schemes comprises selecting auto-regressive prediction;

computing a prediction vector comprises computing the prediction error vector through auto-regressive prediction;

selecting one of a plurality of scaling schemes comprises selecting a scaling factor; and scaling the prediction error vector comprises scaling the prediction error vector prior to quantization using said scaling factor.

10. A method for quantizing linear prediction parameters according to claim 9, wherein the scaling factor is larger than 1.

11. A method for quantizing linear prediction parameters according to claim 2, wherein:

classifying the sound signal frame comprises determining that the sound signal frame is not a stationary voiced frame;

computing a prediction vector comprises computing the prediction error vector through moving-average prediction.

12. A method for quantizing linear prediction parameters according to claim 2, wherein quantizing the prediction error vector comprises:

processing the prediction error vector through a two-stage vector quantization process.

13. A method for quantizing linear prediction parameters according to claim 12, further comprising using split vector quantization in the two stages of the vector quantization process.

14. A method for quantizing linear prediction parameters according to claim 12, wherein quantizing the prediction error vector comprises:

in a first stage of the two-stage vector quantization process, quantizing the prediction error vector to produce a first-stage quantized prediction error vector;

removing from the prediction error vector the first-stage quantized prediction error vector to produce a second-stage prediction error vector;

in the second stage of the two-stage vector quantization process, quantizing the second-stage prediction error vector to produce a second-stage quantized prediction error vector; and producing a quantized prediction error vector by summing the first-stage and second-stage quantized prediction error vectors.

15. A method for quantizing linear prediction parameters according to claim 14, wherein quantizing the second-stage prediction error vector comprises:

processing the second-stage prediction error vector through a moving-average prediction quantizer or an auto-regressive prediction quantizer depending on the classification of the sound signal frame.

16. A method for quantizing linear prediction parameters according to claim 12, wherein quantizing the prediction error vector comprises:

producing quantization indices for the two stages of the two-stage vector quantization process;

transmitting the quantization indices through a communication channel.

17. A method for quantizing linear prediction parameters according to claim 12, wherein:

classifying the sound signal frame comprises determining that the sound signal frame is a stationary voiced frame; and computing a prediction vector comprises:

adding (a) the quantized prediction error vector produced by summing the first-stage and second-stage quantized prediction error vectors and (b) the computed prediction vector to produce a quantized input vector; and processing the quantized input vector through auto-regressive prediction.

18. A method for quantizing linear prediction parameters according to claim 2, wherein:

classifying the sound signal frame comprises determining that the sound signal frame is a stationary voiced frame or non-stationary voiced frame; and for stationary voiced frames, selecting one of a plurality of prediction schemes in relation to the classification of the sound signal frame comprises selecting auto-regressive prediction, computing the prediction vector in accordance with the selected prediction scheme comprises computing the prediction error vector through auto-regressive prediction, selecting at least one of a plurality of scaling scheme in relation to the selected prediction scheme comprises selecting a scaling factor larger than 1, and scaling the prediction error vector in accordance with the selected scaling scheme comprises scaling the prediction error vector prior to quantization using the scaling factor larger than 1;

for non-stationary voiced frames, selecting one of a plurality of prediction schemes in relation to the classification of the sound signal frame comprises selecting moving-average prediction, computing the prediction vector in accordance with the selected prediction scheme comprises computing the prediction error vector through moving-average prediction, selecting at least one of a plurality of scaling scheme in relation to the selected prediction scheme comprises selecting a scaling factor equal to 1, and scaling the prediction error vector in accordance with the selected scaling scheme comprises scaling the prediction error vector prior to quantization using the scaling factor equal to 1.

19. A method of dequantizing linear prediction parameters in variable bit-rate sound signal decoding, comprising:

receiving at least one quantization index;

receiving information about classification of a sound signal frame corresponding to said at least one quantization index;

recovering a prediction error vector by applying said at least one index to at least one quantization table;

reconstructing a prediction vector; and producing a linear prediction parameter vector in response to the recovered prediction error vector and the reconstructed prediction vector;

wherein:

reconstructing a prediction vector comprises processing the recovered prediction error vector through one of a plurality of prediction schemes depending on the frame classification information.

20. A method of dequantizing linear prediction parameters according to claim 19, wherein recovering the prediction error vector comprises:

applying said at least one index and the classification information to at least one quantization table using said one prediction scheme.

21. A method of dequantizing linear prediction parameters according to claim 19, wherein:

receiving at least one quantization index comprises receiving a first-stage quantization index and a second-stage quantization index; and applying said at least one index to said at least one quantization table comprises applying the first-stage quantization index to a first-stage quantization table to produce a first-stage prediction error vector, and applying the second-stage quantization index to a second-stage quantization table to produce a second-stage prediction error vector.

22. A method of dequantizing linear prediction parameters according to claim 21, wherein:

the plurality of prediction schemes comprises moving-average prediction and auto-regressive prediction;

the second-stage quantization table comprises a moving-average prediction table and an auto-regressive prediction table; and said method further comprises applying the sound signal frame classification to the second-stage quantization table to process the second-stage quantization index through the moving-average prediction table or the auto-regressive prediction table depending on the received frame classification information.

23. A method of dequantizing linear prediction parameters according to claim 21, wherein recovering a prediction error vector comprises:

summing the first-stage prediction error vector and the second-stage prediction error vector to produce the recovered prediction error vector.

24. A method of dequantizing linear prediction parameters according to claim 23, further comprising:

conducting on the recovered prediction vector an inverse scaling operation as a function of the received frame classification information.

25. A method of dequantizing linear prediction parameters according to claim 19, wherein producing a linear prediction parameter vector comprises:

adding the recovered prediction error vector and the reconstructed prediction vector to produce the linear prediction parameter vector.

26. A method of dequantizing linear prediction parameters according to claim 25, further comprising adding a vector of mean linear prediction parameters to the recovered prediction error vector and the reconstructed prediction vector to produce the linear prediction parameter vector.

27. A method of dequantizing linear prediction parameters according to claim 19, wherein:

the plurality of prediction schemes comprises moving-average prediction and auto-regressive prediction; and reconstructing the prediction vector comprises processing the recovered prediction error vector through moving-average prediction or processing the produced parameter vector through auto-regressive prediction depending on the frame classification information.

28. A method of dequantizing linear prediction parameters according to claim 27, wherein reconstructing the prediction vector comprises:

processing the produced parameter vector through auto-regressive prediction when the frame classification information indicates that the sound signal frame is stationary voiced; and processing the recovered prediction error vector through moving-average prediction when the frame classification information indicates that the sound signal frame is not stationary voiced.

29. A device for quantizing linear prediction parameters in variable bit-rate sound signal coding, comprising:

means for receiving an input linear prediction parameter vector;

means for classifying a sound signal frame corresponding to the input linear prediction parameter vector;

means for computing a prediction vector;

means for removing the computed prediction vector from the input linear prediction parameter vector to produce a prediction error vector;

means for scaling the prediction error vector;

means for quantizing the scaled prediction error vector;

wherein:

the means for computing a prediction vector comprises means for selecting one of a plurality of prediction schemes in relation to the classification of the sound signal frame, and means for computing the prediction vector in accordance with the selected prediction scheme; and the means for scaling the prediction error vector comprises means for selecting at least one of a plurality of scaling scheme in relation to the selected prediction scheme, and means for scaling the prediction error vector in accordance with the selected scaling scheme.

30. A device for quantizing linear prediction parameters in variable bit-rate sound signal coding, comprising:

an input for receiving an input linear prediction parameter vector;

a classifier of a sound signal frame corresponding to the input linear prediction parameter vector;

a calculator of a prediction vector;

a subtractor for removing the computed prediction vector from the input linear prediction parameter vector to produce a prediction error vector;

a scaling unit supplied with the prediction error vector, said unit scaling the prediction error vector; and a quantizer of the scaled prediction error vector;

wherein:

the prediction vector calculator comprises a selector of one of a plurality of prediction schemes in relation to the classification of the sound signal frame, to calculate the prediction vector in accordance with the selected prediction scheme; and the scaling unit comprises a selector of at least one of a plurality of scaling schemes in relation to the selected prediction scheme, to scale the prediction error vector in accordance with the selected scaling scheme.

31. A device for quantizing linear prediction parameters according to claim 30, wherein:

the quantizer is supplied with the prediction error vector for processing said prediction error vector through the selected prediction scheme.

32. A device for quantizing linear prediction parameters according to claim 31, wherein:

the plurality of prediction schemes comprises moving-average prediction and auto-regressive prediction;

the quantizer comprises:

a two-stage vector quantizer comprising a first-stage codebook itself comprising, in sequence:

a first group of vectors usable when applying moving-average prediction and placed at the beginning of a table;

a second group of vectors usable when applying either moving-average and auto-regressive prediction and placed in the table intermediate the first group of vectors and a third group of vectors;

the third group of vectors usable when applying auto-regressive prediction and placed at the end of the table;

the prediction error vector processing means comprises:

when the selected prediction scheme is moving-average prediction, means for processing the prediction error vector through the first and second groups of vectors of the table; and when the selected prediction scheme is auto-regressive prediction, means for processing the prediction error vector through the second and third groups of vectors.

33. A device for quantizing linear prediction parameters according to claim 32, further comprising, to ensure interoperability with the AMR-WB standard, a mapping table establishing mapping between the position of a first-stage vector in the table of the first-stage codebook and an original position of the first-stage vector in an AMR-WB first-stage codebook.

34. A device for quantizing linear prediction parameters according to claim 30, wherein:

the plurality of prediction schemes comprises moving-average prediction and auto-regressive prediction.

35. A device for quantizing linear prediction parameters according to claim 34, wherein:

the quantizer comprises a two-stage vector quantizer comprising first and second stages; and the two-stage vector quantizer comprises first-stage quantization tables that are identical for both moving-average and auto-regressive prediction.

36. A device for quantizing linear prediction parameters according to claim 34, wherein:

the prediction vector calculator comprises an auto-regressive predictor for applying auto-regressive prediction to the prediction error vector and a moving-average predictor for applying moving-average prediction to the prediction error vector; and the auto-regressive predictor and moving-average predictor comprise respective memories that are updated every sound signal frame, assuming that either moving-average or auto-regressive prediction can be used in a next frame.

37. A device for quantizing linear prediction parameters according to claim 30, further comprising:

means for producing a vector of mean linear prediction parameters; and a subtractor for removing the vector of mean linear prediction parameters from the input linear prediction parameter vector to produce a mean-removed input linear prediction parameter vector.

38. A device for quantizing linear prediction parameters according to claim 30 wherein, when the classifier determines that the sound signal frame is a stationary voiced frame, the prediction vector calculator comprises:

an auto-regressive predictor for applying auto-regressive prediction to the prediction error vector.

39. A device for quantizing linear prediction parameters according to claim 38, wherein the scaling unit comprises:

a multiplier for applying to the prediction error vector a scaling factor larger than 1.

40. A device for quantizing linear prediction parameters according to claim 30, wherein, when the classifier determines that the sound signal frame is not a stationary voiced frame:

the prediction vector calculator comprises a moving-average predictor for applying moving-average prediction to the prediction error vector.

41. A device for quantizing linear prediction parameters according to claim 30, wherein the quantizer comprises a two-stage vector quantizer.

42. A device for quantizing linear prediction parameters according to claim 41, wherein the two-stage vector quantizer comprises two stages using split vector quantization.

43. A device for quantizing linear prediction parameters according to claim 41, wherein the two-stage vector quantizer comprises:

a first-stage vector quantizer supplied with the prediction error vector for quantizing said prediction error vector and producing a first-stage quantized prediction error vector;

a subtractor for removing from the prediction error vector the first-stage quantized prediction error vector to produce a second-stage prediction error vector;

a second-stage vector quantizer supplied with the second-stage prediction error vector for quantizing said second-stage prediction error vector and producing a second-stage quantized prediction error vector; and an adder for producing a quantized prediction error vector by summing the first-stage and second-stage quantized prediction error vectors.

44. A device for quantizing linear prediction parameters according to claim 43, wherein the second-stage vector quantizer comprises:

a moving-average second-stage vector quantizer for quantizing the second-stage prediction error vector using moving-average prediction; and an auto-regressive second-stage vector quantizer for quantizing the second-stage prediction error vector using auto-regressive prediction.

45. A device for quantizing linear prediction parameters according to claim 41, wherein the two-stage vector quantizer comprises:

a first-stage vector quantizer for producing a first-stage quantization index;

a second-stage vector quantizer for producing a second-stage quantization index; and a transmitter of the first-stage and second-stage quantization indices through a communication channel.

46. A device for quantizing linear prediction parameters according to claim 43, wherein, when the classifier determines that the sound signal frame is a stationary voiced frame, the prediction vector calculator comprises:

an adder for summing (a) the quantized prediction error vector produced by summing the first-stage and second-stage quantized prediction error vectors and (b) the computed prediction vector to produce a quantized input vector; and an auto-regressive predictor for processing the quantized input vector.

47. A device for dequantizing linear prediction parameters in variable bit-rate sound signal decoding, comprising:

means for receiving at least one quantization index;

means for receiving information about classification of a sound signal frame corresponding to said at least one quantization index;

means for recovering a prediction error vector by applying said at least one index to at least one quantization table;

means for reconstructing a prediction vector;

means for producing a linear prediction parameter vector in response to the recovered prediction error vector and the reconstructed prediction vector;

wherein:

the prediction vector reconstructing means comprises means for processing the recovered prediction error vector through on of a plurality of prediction schemes depending on the frame classification information.

48. A device for dequantizing linear prediction parameters in variable bit-rate sound signal decoding, comprising:

means for receiving at least one quantization index;

means for receiving information about classification of a sound signal frame corresponding to said at least one quantization index;

at least one quantization table supplied with said at least one quantization index for recovering a prediction error vector;

a prediction vector reconstructing unit;

a generator of a linear prediction parameter vector in response to the recovered prediction error vector and the reconstructed prediction vector;

wherein:

the prediction vector reconstructing unit comprises at least one predictor supplied with recovered prediction error vector for processing the recovered prediction error vector through one of a plurality of prediction schemes depending on the frame classification information.

49. A device for dequantizing linear prediction parameters according to claim 48, wherein said at least one quantization table comprises:

a quantization table using said one prediction scheme and supplied with both said at least one index and the classification information.

50. A device for dequantizing linear prediction parameters according to claim 48, wherein:

the quantization index receiving means comprises two inputs for receiving a first-stage quantization index and a second-stage quantization index; and said at least one quantization table comprises a first-stage quantization table supplied with the first-stage quantization index to produce a first-stage prediction error vector, and a second-stage quantization table supplied with the second-stage quantization index to produce a second-stage prediction error vector.

51. A device for dequantizing linear prediction parameters according to claim 50, wherein:

the plurality of prediction schemes comprises moving-average prediction and auto-regressive prediction;

the second-stage quantization table comprises a moving-average prediction table and an auto-regressive prediction table; and said device further comprises means for applying the sound signal frame classification to the second-stage quantization table to process the second-stage quantization index through the moving-average prediction table or the auto-regressive prediction table depending on the received frame classification information.

52. A device for dequantizing linear prediction parameters according to claim 50, further comprising:

an adder for summing the first-stage prediction error vector and the second-stage prediction error vector to produce the recovered prediction error vector.

53. A device for dequantizing linear prediction parameters according to claim 52, further comprising:

means for conducting on the reconstructed prediction vector an inverse scaling operation as a function of the received frame classification information.

54. A device for dequantizing linear prediction parameters according to claim 48, wherein the generator of linear prediction parameter vector comprises:

an adder of the recovered prediction error vector and the reconstructed prediction vector to produce the linear prediction parameter vector.

55. A device for dequantizing linear prediction parameters according to claim 54, further comprising means for adding a vector of mean linear prediction parameters to the recovered prediction error vector and the reconstructed prediction vector to produce the linear prediction parameter vector.

56. A device for dequantizing linear prediction parameters according to claim 48, wherein:

the plurality of prediction schemes comprises moving-average prediction and auto-regressive prediction; and the prediction vector reconstructing unit comprises a moving-average predictor and an auto-regressive predictor for processing the recovered prediction error vector through moving-average prediction or for processing the produced parameter vector through auto-regressive prediction depending on the frame classification information.

57. A device for dequantizing linear prediction parameters according to claim 56, wherein the prediction vector reconstructing unit comprises:

means for processing the produced parameter vector through the auto-regressive predictor when the frame classification information indicates that the sound signal frame is stationary voiced; and means for processing the recovered prediction error vector through the moving-average predictor when the frame classification information indicates that the sound signal frame is not stationary voiced.

58. A device for dequantizing linear prediction parameters according to claim 56, wherein:

said at least one predictor comprises an auto-regressive predictor for applying auto-regressive prediction to the prediction error vector and a moving-average predictor for applying moving-average prediction to the prediction error vector; and the auto-regressive predictor and moving-average predictor comprise respective memories that are updated every sound signal frame, assuming that either moving-average or auto-regressive prediction can be used in a next frame.

* * * * *